US005487468A

United States Patent [19]

Sheahan

[11] Patent Number: 5,487,468

[45] Date of Patent: Jan. 30, 1996

[54] CIGARETTE PACKAGE DESIGN

[75] Inventor: Michael H. Sheahan, Whitby, Canada

[73] Assignee: Rothmans, Benson & Hedges Inc., North York, Canada

[21] Appl. No.: 348,234

[22] Filed: Nov. 28, 1994

Related U.S. Application Data

[63] Continuation of Ser. No. 992,784, Dec. 18, 1992, abandoned.

[30] Foreign Application Priority Data

Dec. 18, 1991 [GB] United Kingdom ..... 9126854

[51] Int. Cl.[6] ..... B65D 85/10

[52] U.S. Cl. ..... 206/242; 206/822; 229/109; 229/110

[58] Field of Search ..... 206/242, 256, 206/258, 264, 268, 269, 270, 271, 273, 457, 526, 822; 229/8, 160.1, 109, 110; D9/337, 423, 430, 433; D27/189

[56] References Cited

U.S. PATENT DOCUMENTS

| | | | |
|---|---|---|---|
| D. 28,639 | 5/1898 | Gere | D9/430 |
| 242,065 | 5/1881 | Smith | 206/256 |
| D. 296,938 | 7/1988 | Ameringen | D9/423 |
| D. 298,412 | 11/1988 | Ciuba | D9/430 |
| D. 333,532 | 2/1993 | Campbell | D27/189 |
| 1,892,715 | 1/1933 | Wellman | 229/109 |
| 4,753,384 | 6/1988 | Focke et al. | 229/160.1 |
| 5,097,948 | 3/1992 | Campbell | 206/273 |

FOREIGN PATENT DOCUMENTS

| | | | |
|---|---|---|---|
| 0425163 | 2/1926 | Germany | 206/242 |
| 0017650 | 8/1927 | Netherlands | 206/268 |

*Primary Examiner*—Jimmy G. Foster
*Attorney, Agent, or Firm*—Sim & McBurney

[57] ABSTRACT

A cigarette package is dimensioned to hold an array of cigarettes in multiple rows and comprises a plurality of vertical walls defining a hexagon in cross-section. The walls are dimensioned to bear against an array of cigarettes in the package and having the same cross-sectional shape as the package. The package has a distinctive external appearance while permitting twenty or twenty-five cigarettes to be accommodated in three or four rows in the array.

1 Claim, 6 Drawing Sheets

FIG.4A.
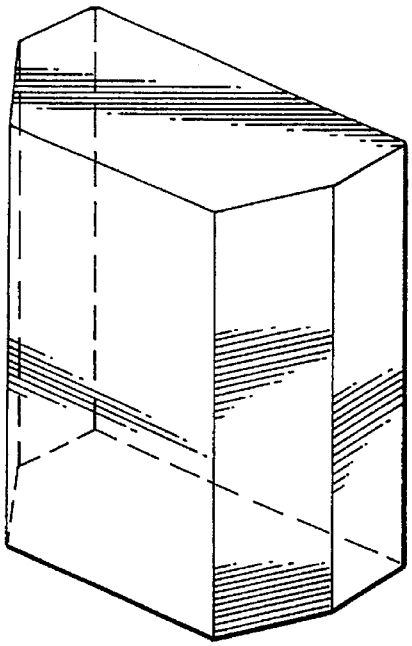
FIG.4B.
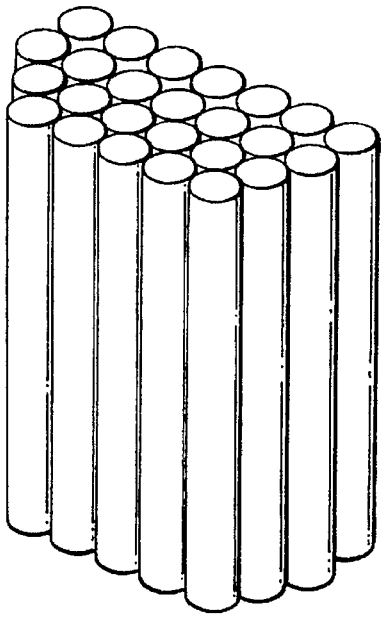
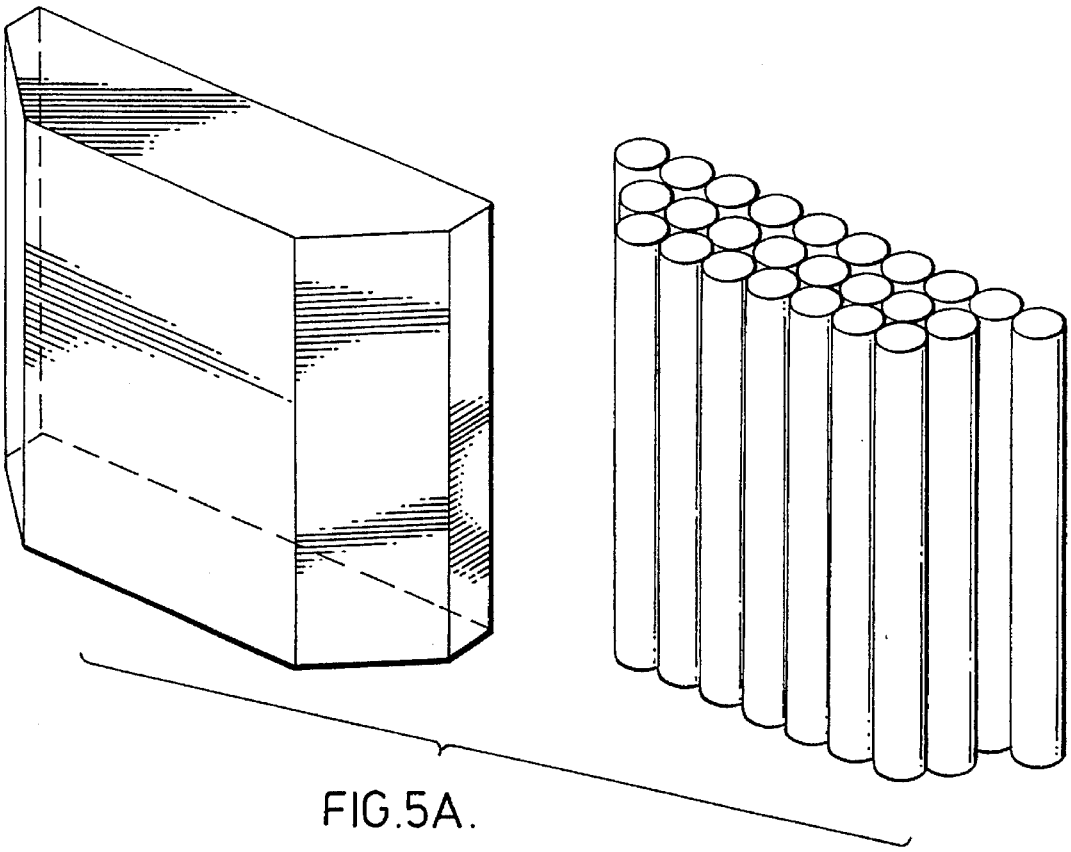
FIG.5A.

FIG. 8a.
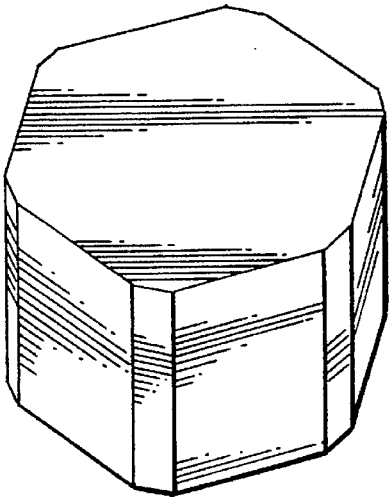
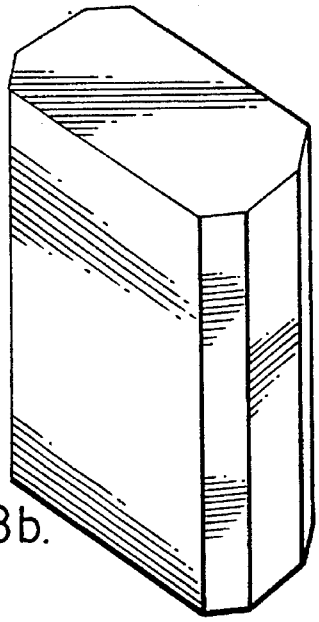
FIG. 8b.
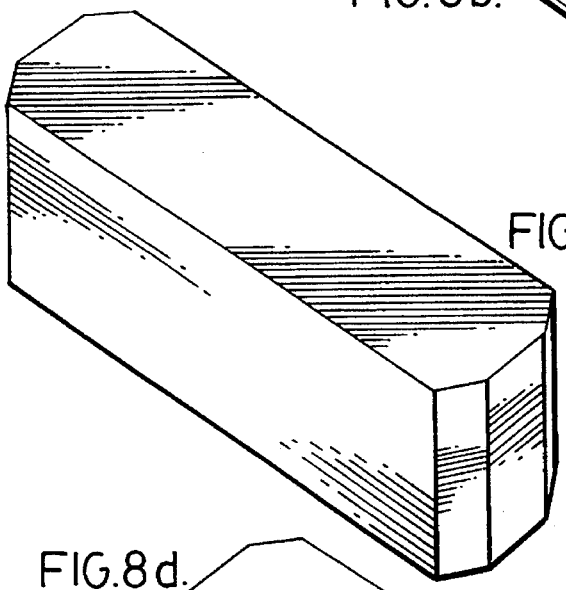
FIG. 8c.
FIG. 8d.
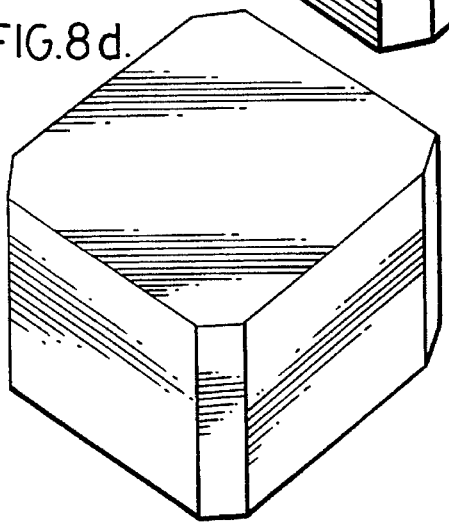
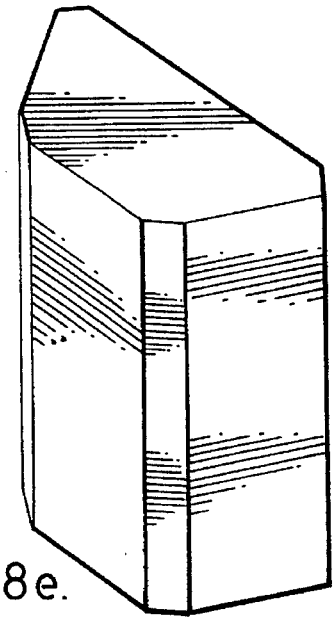
FIG. 8e.

CIGARETTE PACKAGE DESIGN

This is a continuation of application Ser. No. 07/992,784 filed Dec. 18, 1992, abandoned.

FIELD OF THE INVENTION

The present invention relates to a novel cigarette package design having a distinctive external appearance and intended to house twenty or twenty-five cigarettes in multiple row arrays.

BACKGROUND TO THE INVENTION

Cigarettes are sold in packages of twenty or twenty-five in a rectangular cross-section package, which may be a "flip-top" or "slide-and-shell" type. It is known from U.S. Pat. No. 4,753,384 to provide a flip-top cigarette package with vertical longitudinal edges which are bevelled, providing an octagonal shape in cross-section. However, the two dimensions of the bevelled edges are such that the cigarettes are still packaged in the same array as in a conventional cigarette package.

SUMMARY OF THE INVENTION

In accordance with the present invention, there is provided a novel form of cigarette package which is hexagonal in cross-section and hence has a distinctive external appearance. The faces of the hexagonal shape are dimensioned so that the cigarettes present in the package, whether numbered twenty or twenty-five, bear against the faces, so that the cross-sectional shape of the array of cigarettes, arranged in multiple rows, often nested, corresponds to the; cross-sectional shape of the package.

The hexagonal shape provides a distinctive external appearance to the package. The package may be dimensioned to provide for accommodation of twenty or twenty-five cigarettes in three or four rows.

The invention also include cartons of a variety of regular polygonal shapes containing multiples of such cigarette packages.

BRIEF DESCRIPTION OF DRAWINGS

FIG. 2A is a perspective view corresponding to FIG. 1A while

FIG. 4A is a perspective view corresponding to FIG. 3A while FIG. 4B is a perspective view corresponding to FIG. 3B;

FIGS. 5A, 5B and 5C are perspective views of three alternative designs of cigarette packages for housing twenty-five cigarettes.

FIGS. 8A, 8B, 8C, 8D and 8E are perspective views of a variety of alternative geometric shapes of cartons designed to house various designs of cigarette packages containing twenty-five cigarettes, arranged in four row arrays.

Hereafter, references to drawing figures that refer only to a number will, in effect, refer to the views beginning with that number.

DESCRIPTION OF PREFERRED EMBODIMENTS

Figure 1A:
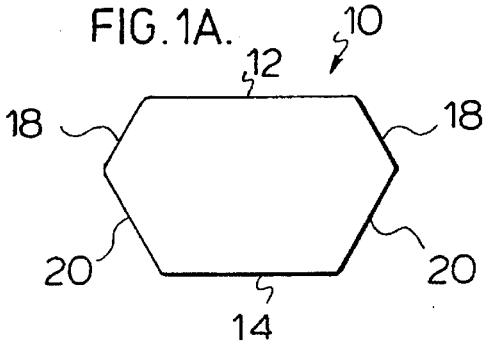
FIG. 1A is a plan view of a cigarette package provided in accordance with one embodiment of the invention.
Figure 1B:
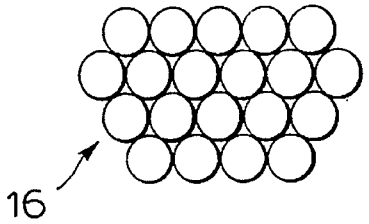
FIG. 1B is a plan view of twenty nested cigarettes for positioning in the cigarette package of FIG. 1A.
Figure 2A:
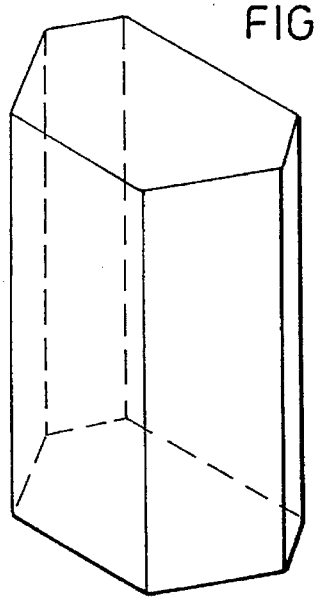
Figure 2B:
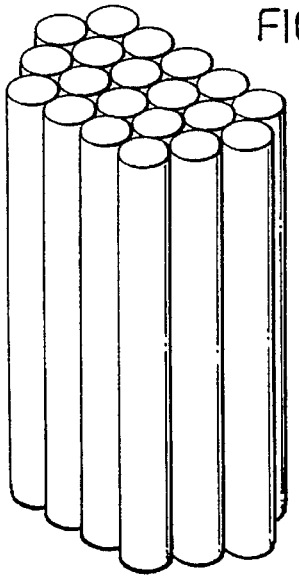
FIG. 2B is a perspective view corresponding to FIG. 1B.

Referring to the drawings, as seen in FIGS. 1 and 2, a cigarette package 10 intended to package 20 cigarettes is provided with a regular hexagonal cross-section. Front and rear walls 12 and 14 are parallel to one another, with the rear wall 12 being dimensioned to engage five cigarettes of a nested array 16 of cigarettes and the front wall 14 being dimensioned to engage four cigarettes of the nested cigarette array 16. First side walls 18 extend at an obtuse angle away from each end of the rear wall 12 while second side walls 20 extend at an obtuse angle away from each end of the front wall 14 to integrally join with the first side walls 18 at a further obtuse angle.

The first side walls 18 have a length which engages two cigarettes of the nested array 16, one in common with the rear wall 12, while the second side walls 20 have a length which engages three cigarettes, one in common with the first side walls 18 and one in common with the front wall 12. Accordingly, the twenty cigarettes arranged in the nested array 16 comprise four rows of cigarettes, numbering five, six, five and four cigarettes in each row from the rear wall 12 to the front wall 14.

Figure 3A:
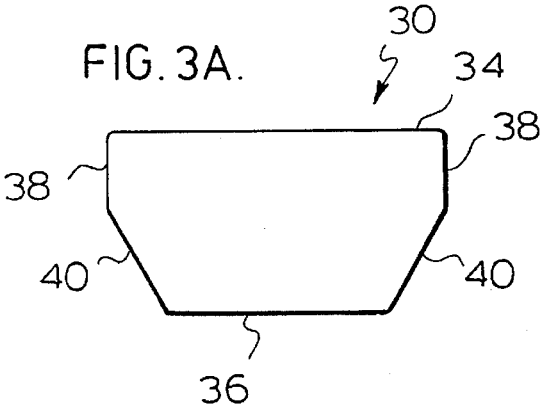
FIG. 3A is a plan view of a cigarette package provided in accordance with another embodiment of the invention.
Figure 3B:
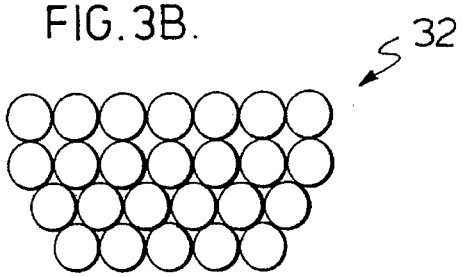
FIG. 3B is a plan view of twenty-five nested cigarettes for positioning in the cigarette package of FIG. 3A.

Referring now to FIGS. 3 and 4, there is shown therein a modified form of the package of FIGS. 1 and 2, adapted for twenty-five cigarettes. The package structure 30 is intended to accommodate a nested pack 32 of cigarettes, containing twenty-five cigarettes, arranged in four rows, two rows containing seven cigarettes, one row containing six cigarettes and one row containing five cigarettes.

The package structure 30 include parallel front and rear walls 34 and 36 which are dimensioned to engage the rear seven-cigarette row and the front five-cigarette row extending at right angles from the ends of the rear wall 34 are first side walls 38, of a length which engages two cigarettes, one in common with the rear wall 34. Second side walls 40 extend at a obtuse angle away from the ends of the front wall 36 to integrally join with the first side walls 38 at a further obtuse angle. The second side walls 40 have a length which engages three cigarettes, one in common with the first side walls 38 and are in common with the front wall 36.

As in the case of the embodiment of FIGS. 1 and 2, the four rows of cigarettes in the nested array 32 are received snugly in the package structure 30 and are engaged by the various walls of the package structure.

Figure 6A:
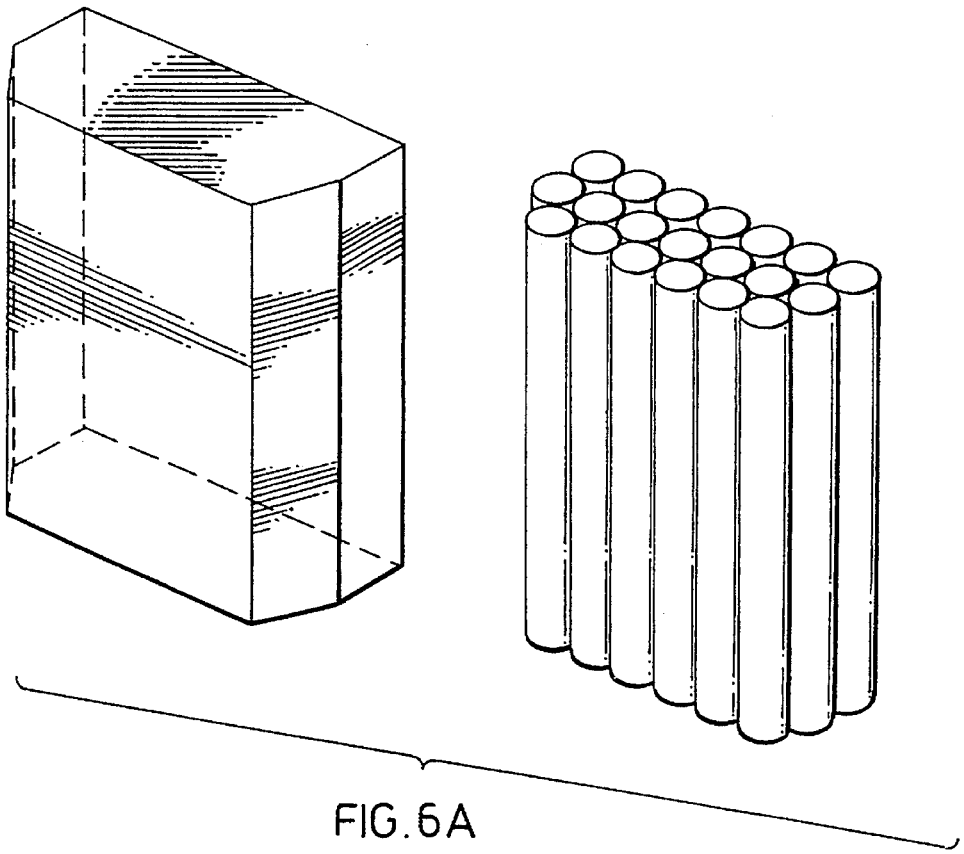
FIGS. 6A and 6B are perspective views of two alternative designs of cigarette packages for housing twenty cigarettes.

The structure illustrated in FIGS. 3 and 4 may be modified to accommodate twenty cigarettes in three rows rather than twenty-five in four rows in one of two ways, as seen in FIG. 6. In a fist modification, the second side walls 40 are dimensioned to accommodate only one cigarette along its length, rather than two, so that the twenty cigarettes are provided in three rows, two of seven cigarettes and one of six cigarettes (FIG. 6A).

Figure 6B:
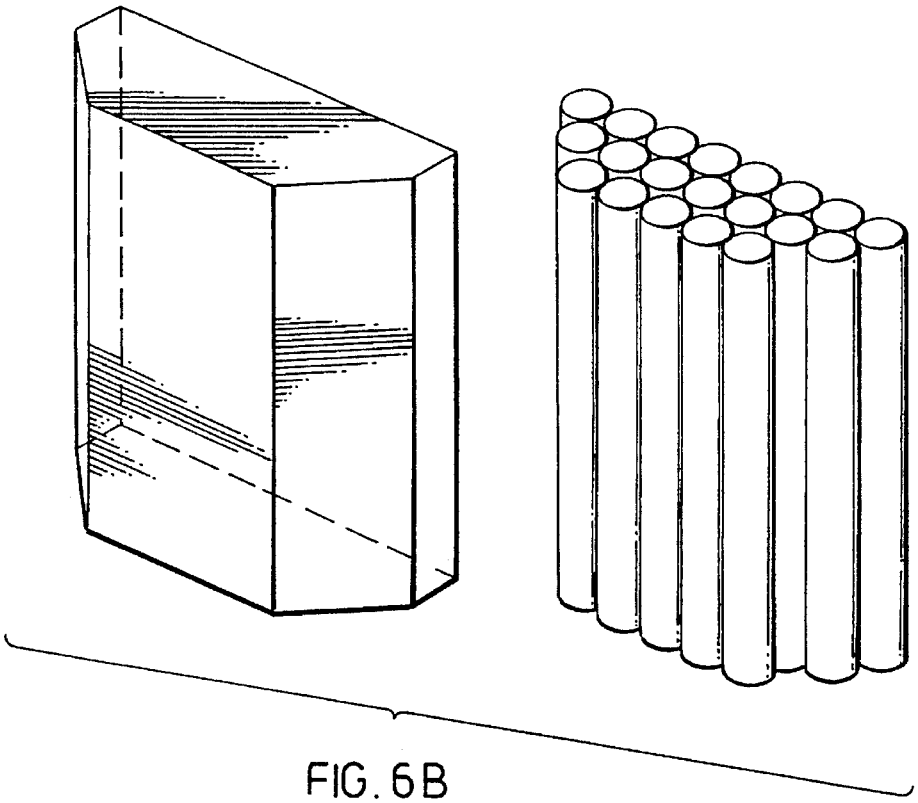
Figure 7A:
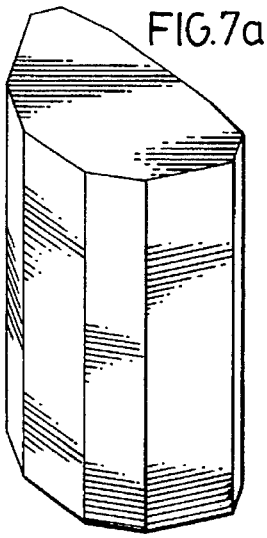
FIGS. 7A, 7B, 7C, 7D, 7E, 7F and 7G are perspective views of alternative geometric shapes of cartons designed to house various designs of cigarette packages containing twenty cigarettes, arranged either in three or four row arrays, as illustrated in FIGS. 1A, 1B, 2A and 2B or in FIGS. 6A or 6B.
Figure 7B:
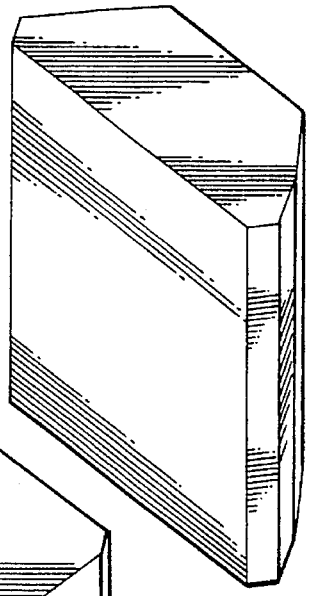
Figure 7C:
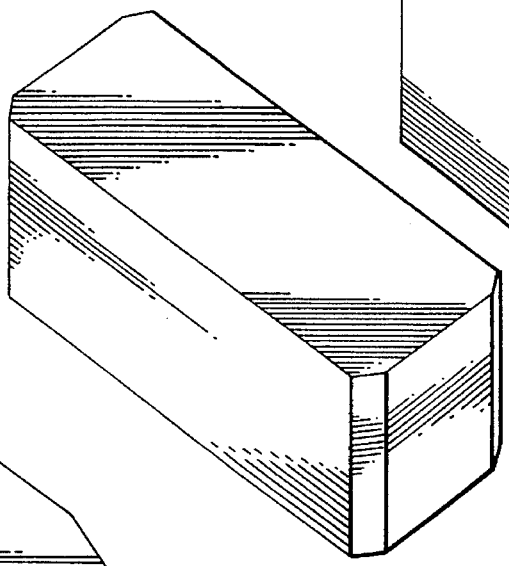
Figure 7D:
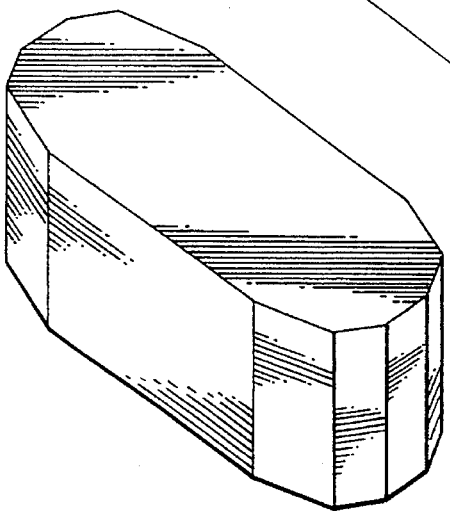
Figure 7E:
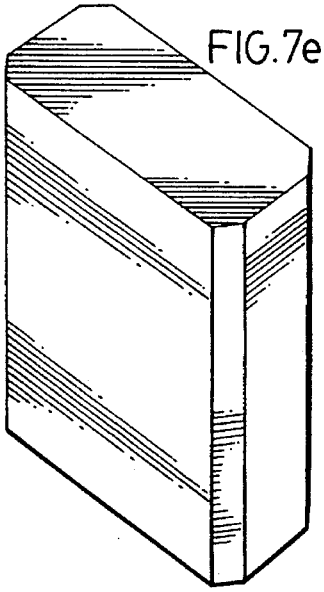
Figure 7F:
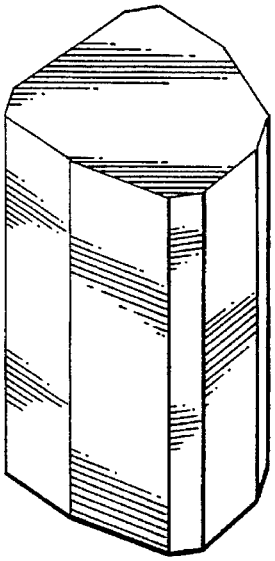
Figure 7G:
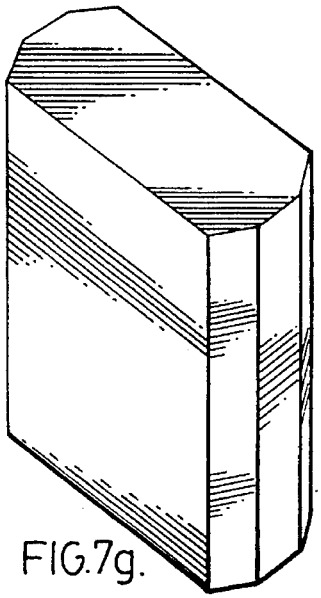

In a second modification, the first side walls 38 are dimensioned to accommodate only one cigarette along its length, rather than two, while the length of the rear wall is increased to accommodate an additional cigarette, so that the twenty cigarettes are provided in three rows, one of eight cigarettes, one of seven cigarettes and one of five cigarettes (FIG. 6B).

While these illustrated embodiments show hexagonal cross-sectional package structure suitable for use with nested arrays of twenty and twenty-five cigarettes, since these numbers are those commonly employed commercially, the structure may be adapted for other convenient multiples of cigarettes arranged in a uniform array.

Figure 5B:
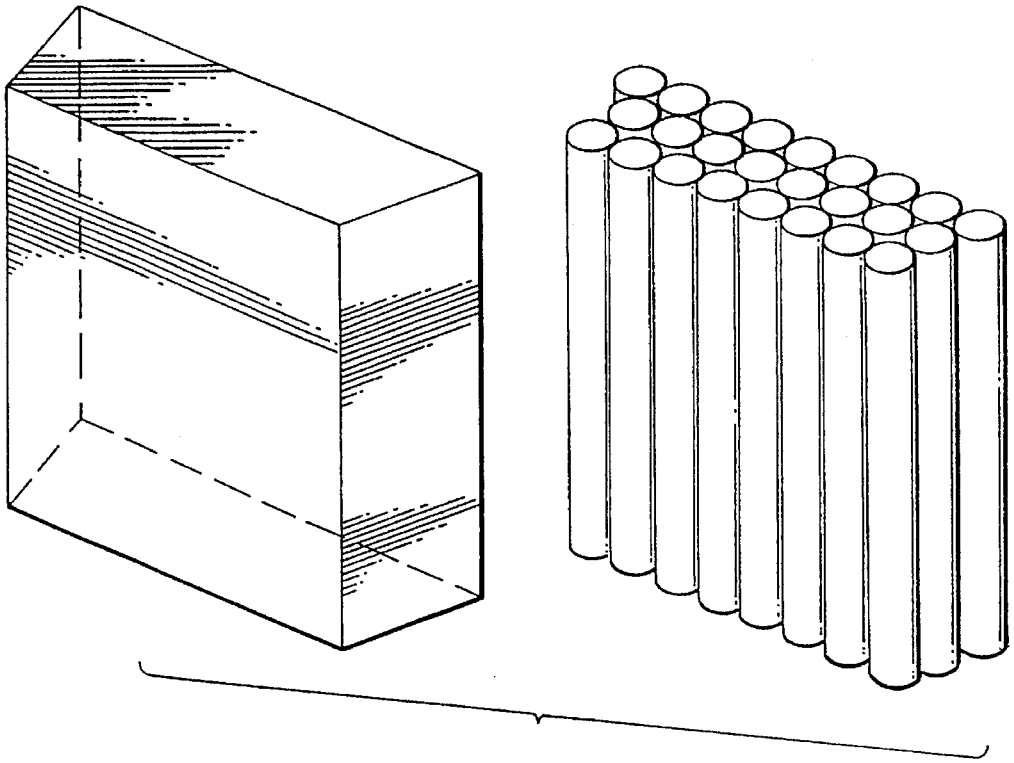
Figure 5C:
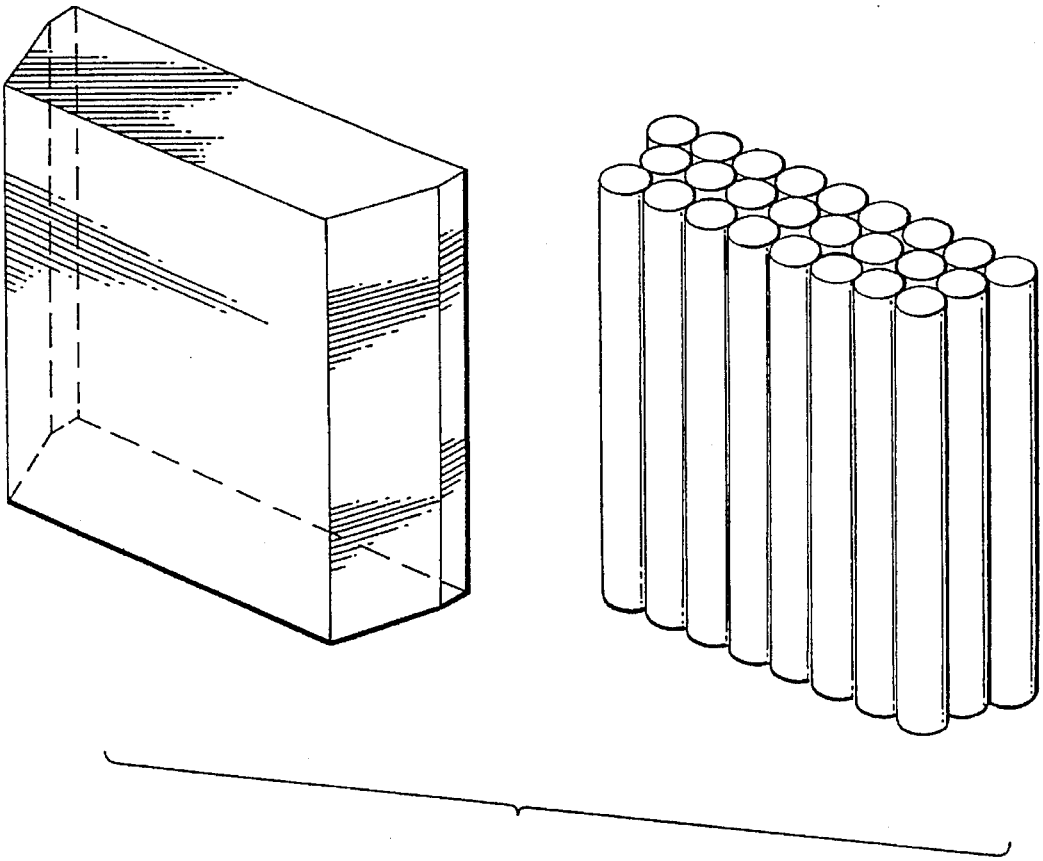

FIGS. 5 and 6 illustrate other alternative embodiments of the invention. FIG. 5 shows alternative dimensioning (5A) and (5C) and cross-sectional arrangement (5B) to enable twenty-five cigarettes to be accommodated in three rows. In the case of FIGS. 5B and 5C, the front two rows are not nested, although the middle row is nested with the rear row.

FIG. 6 shows alternative dimensioning of the package to enable twenty cigarettes to be accommodated in three rows. In the case of FIG. 6A, the two front rows are nested whale the rear two are not, while in FIG. 6B, the two rear rows are nested while the front two are not.

FIG. 7 illustrates a number of alternative cross-sectional shapes of carton possessing eight, ten or twelve sides and dimensioned to house a plurality of cigarette packages containing twenty cigarettes in three or four rows, as illustrated in FIGS. 1, 2 and 6.

FIG. 8 similarly illustrates a number of alternative cross-sectional shapes of carton possessing eight or twelve sides and dimensioned to house a plurality of cigarette packages containing twenty-five cigarettes in four rows, as seen in FIGS. 3 and 4.

SUMMARY OF DISCLOSURE

In summary of this disclosure, the present invention provides a novel cigarette package structure which has a polygonal cross-sectional shape adapted to house an array of cigarettes arranged in multiple rows and to engage and support the array when located in the packaging structure. Modifications are possible within the scope of this invention.

What I claim is:

1. A cigarette package containing cigarettes in an array of said cigarettes arranged in multiple rows, each cigarette in said array having the same cross-sectional dimension and the same length, said cigarette package comprising a plurality of vertical walls defining a hexagon in cross-sectional shape, said plurality of walls being dimensioned such that said array of cigarettes contained in said package bears against the walls, so that said array of cigarettes has the same cross-sectional shape as said package, said array of cigarettes being in the form of a nested array of twenty cigarettes in four rows, said plurality of vertical walls defining a hexagon comprising a front wall, a rear wall parallel to said front wall, first side walls extending at an obtuse angle away from each end of the rear wall and second side walls extending at an obtuse angle away from each end of the front wall to integrally join with the first side walls at a further obtuse angle, said rear wall engaging five cigarettes in a rear row of said nested array, said front wall engaging four cigarettes in a front row of said nested array, said first side walls engaging the end cigarettes of the rear row and an adjacent row to said rear row in said nested array containing six cigarettes and said second side walls engaging the end cigarettes of the front row and an adjacent row to said front row in said nested array containing five cigarettes.

* * * * *